US007651016B2

(12) United States Patent
Stewart

(10) Patent No.: US 7,651,016 B2
(45) Date of Patent: Jan. 26, 2010

(54) COMBINATION WAIST PACK WHICH UNFOLDS PROVIDING A GARMENT AND A PROTECTIVE ACCESSORY PROVIDING COMFORT AND PROTECTION TO COMBINED PARTS OF A PERSON FOR USE IN OUTDOOR SPORTS AND RECREATION

(75) Inventor: Daniel Roy Stewart, Salt Lake, UT (US)

(73) Assignee: Daniel R. Stewart, Salt Lake, UT (US)

( * ) Notice: Subject to any disclaimer, the term of this patent is extended or adjusted under 35 U.S.C. 154(b) by 139 days.

(21) Appl. No.: 10/618,124

(22) Filed: Jul. 11, 2003

(65) Prior Publication Data

US 2004/0069827 A1 Apr. 15, 2004

Related U.S. Application Data

(60) Provisional application No. 60/395,121, filed on Jul. 11, 2002.

(51) Int. Cl.
*A45F 4/00* (2006.01)

(52) U.S. Cl. ..... 224/577; 2/69.5; 2/467; 5/417; 224/241; 224/660; 224/676

(58) Field of Classification Search ..... 224/236, 224/237, 240, 241, 577, 660, 662–676, 680, 224/681; 2/69.5, 467; 5/417, 419, 420; 383/4
See application file for complete search history.

(56) References Cited

U.S. PATENT DOCUMENTS 2,315,095 A * 3/1943 Rhodes ..... 224/677
2,540,165 A * 2/1951 Fiel ..... 5/419
3,185,362 A * 5/1965 Wakefield ..... 2/467
3,708,799 A * 1/1973 Smithdeal ..... 2/46
3,977,516 A * 8/1976 Tilve ..... 224/240
4,047,650 A * 9/1977 Domingos ..... 224/236
4,164,275 A * 8/1979 Davis ..... 5/417
4,837,859 A * 6/1989 Hamberg ..... 2/467
4,852,783 A * 8/1989 Bryden et al. ..... 224/240

(Continued)

FOREIGN PATENT DOCUMENTS

GB 2104774 A * 3/1983

*Primary Examiner*—Gary E Elkins

(57) ABSTRACT

A combination waist pack is worn comfortably about the waist and unfolds to provide a protective accessory such as a seat cushion, water resistant or insulated barrier to kneel or lay down upon, or other apparel or padded articles providing protection to various parts of a person for use in outdoor sports and recreation. The invention is convertible to a seat or other protective device while unfolded and a warm & protective waistband, hand warmer & padded pack while folded. A user is not required to attach a seat accessory as an addition to the invention nor does he/she have to take up additional space by placing it in a pocket. Therefore, the invention is less bulky even when using thicker materials for padding. The invention is also simpler to utilize than previous inventions. The invention provides seating, padding, & warmth. It is more desirable, more fashionable, more convenient, less noticeable, and more comfortable for sports and leisure. Versions include securing straps, buckles, or other attachments to attach to sports equipment or vehicles or to wrap protective garments around body. An optional version provides a heat or chemical resistant garment.

22 Claims, 3 Drawing Sheets

U.S. PATENT DOCUMENTS 5,003,634 A * 4/1991 Brinkman ..... 224/662
5,241,706 A * 9/1993 Netz ..... 2/46
5,269,023 A * 12/1993 Ross ..... 224/664
5,439,154 A * 8/1995 Delligatti ..... 224/237
5,588,749 A * 12/1996 Ishikawa ..... 383/4
5,785,219 A * 7/1998 Kraft ..... 383/4
5,871,132 A * 2/1999 Hargreaves ..... 224/577
5,920,931 A * 7/1999 Zuehlke et al. ..... 5/419
6,036,260 A * 3/2000 Mullen ..... 2/69.5
6,196,436 B1 * 3/2001 Williams ..... 224/660
6,244,486 B1 * 6/2001 Holland et al. ..... 224/236
6,345,396 B1 * 2/2002 Schuler ..... 2/467
6,393,638 B1 * 5/2002 MacColl ..... 5/419
6,698,636 B2 * 3/2004 Angus et al. ..... 224/660
2002/0050503 A1 * 5/2002 Spero ..... 224/655

* cited by examiner

Fig. 1
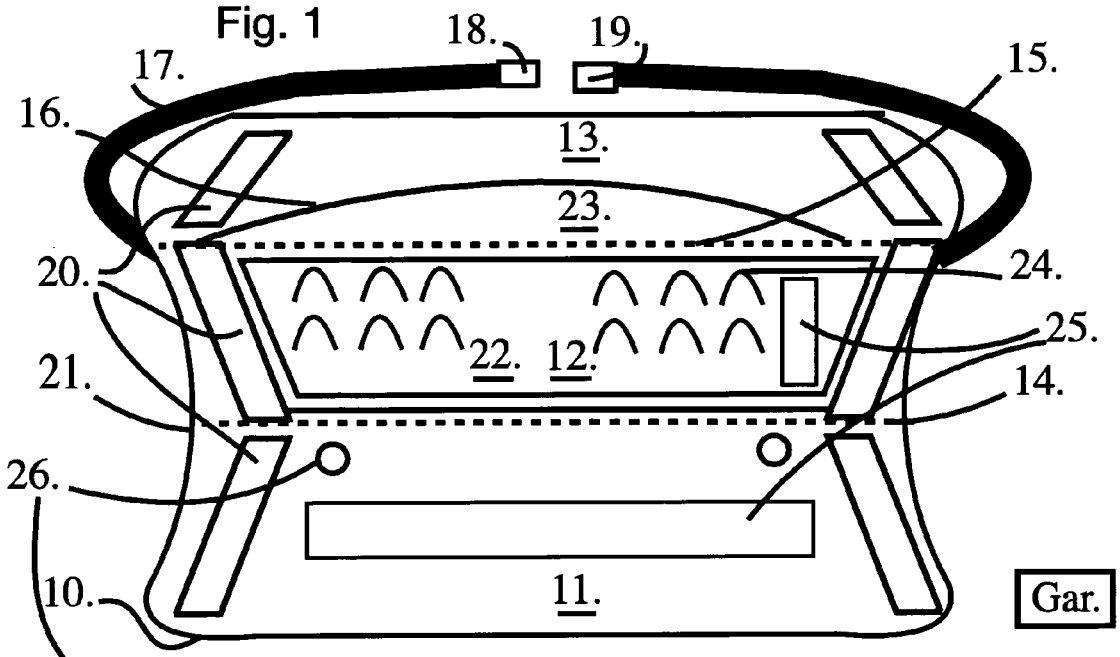
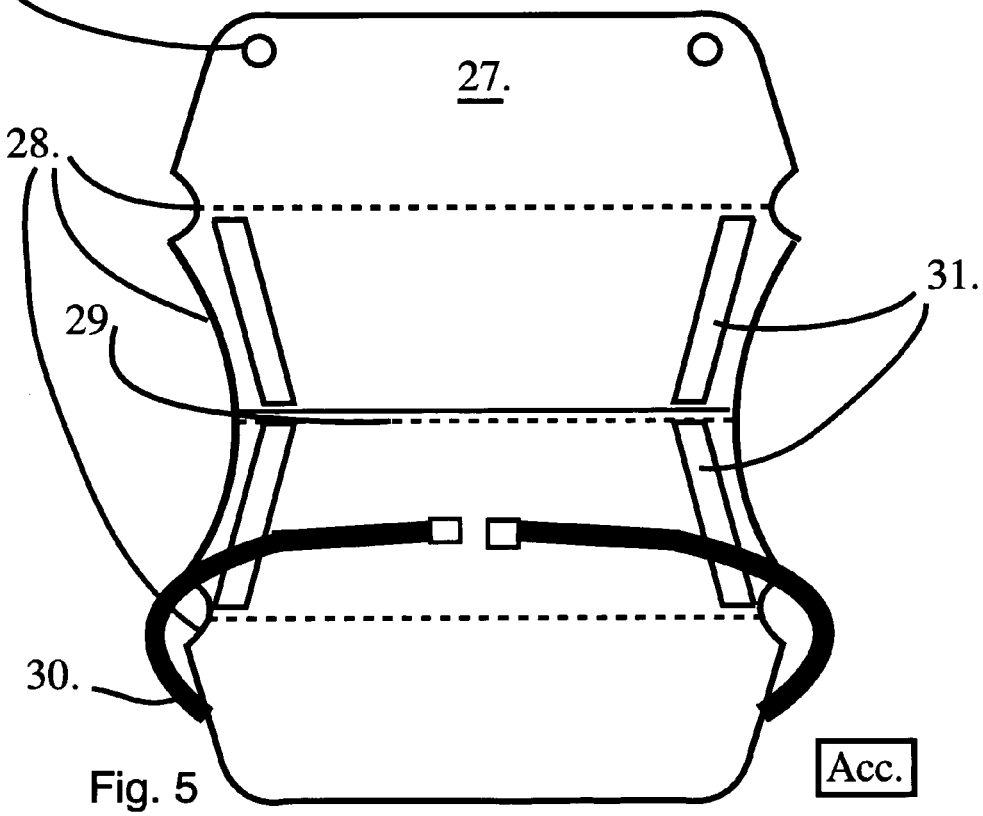
Fig. 5

COMBINATION WAIST PACK WHICH UNFOLDS PROVIDING A GARMENT AND A PROTECTIVE ACCESSORY PROVIDING COMFORT AND PROTECTION TO COMBINED PARTS OF A PERSON FOR USE IN OUTDOOR SPORTS AND RECREATION

CROSS-REFERENCE TO RELATED APPLICATIONS

Applicant claims the benefit of the priority of its U.S. Provisional Application Ser. No. Patent Application No. 60/395,121, filed Jul. 11, 2002, which application is expressly incorporated herein.

STATEMENT REGARDING FEDERALLY SPONSORED RESEARCH OR DEVELOPMENT

"Not applicable"

REFERENCE TO A MICROFICHE APPENDIX

"Not applicable"

BACKGROUND OF INVENTION

The field of this invention relates to wearing apparel and sport padding which is incorporated into a combination pack that is worn on a person's waist. The multi-purpose waist pack includes protective garments, which can be folded and/or unfolded in different configurations to form numerous variations of the invention. Combination belt packs have been described in patent literature.

The invention is convertible to a seat or other protective device while unfolded and a warm & protective waistband, hand warmer & padded pack while folded. A user is not required to attach a seat accessory as an addition to the invention nor does he/she have to take up additional space by placing it in a pocket. Therefore, the invention is less bulky even when using thicker materials for padding. The invention is also simpler to utilize than previous inventions. The invention provides seating, padding, & warmth. It is more desirable, more fashionable, more convenient, less noticeable, and more comfortable for sports, spectating, and leisure. The invention provides protective seating, leg padding or insulation and worn is on the waist of person for outdoor sports.

Articles for padding and insulation for skiing or other sports have been described in Patent literature.

Numerous waist packs have been developed but none combine protective garments in such a manner as this invention. An item, in which gear is allowed, such as a daypack, does not generally have an alternative purpose such as comfort, which exists in a small, slender, and comfortable article. The small slender size and comfort, is achieved by the invention's multi-functional attributes and adaptable character. As preferred, the invention utilizes stretchy, insulated, padded material such as neoprene which provides a slender water-resistant, insulate, for a seat &/or leg padding while unfolded and further provides a stretchy and doubly warm waist, kidney, tummy, and hand warmer or protective pack while folded. One can place articles such sports equipment, a c.d. player or other audio or entertainment equipment in the fold and between the layers of the invention's padded garment/s to protect and secure the articles within the pack. Elastic straps or other means of attachment as well as pockets are provided for tools or other accessories and are placed in various locations on the invention's panels. Straps are sewn in loop fashion and in diagonal, vertical, and horizontal positions of varying sizes to accommodate many varieties of tools & for easy side and top access. Straps placed in vertical position, allow articles to be secured horizontally allowing larger tools to fit in pack and make it less likely that the ends or tips would puncture the pack. Optional versions offer thin and strong lightweight materials such as nylon, Kevlar or thinner and stronger rubbers placed on panels to further prevent tools puncturing the invention. Optional versions provide straps on lower panel/s to secure protective garment around both legs & the lower torso to be used during sports. Also, a user may place his hands against or inside the invention for padding and warmth. Since the invention's seat or leg padding function while unfolded also functions as the waist, tummy, kidney warmer, and also forms the pack and a hand warmer while folded, less material is required and less bulkiness is obtained. The invention is unique and overcomes the problems associated with previous inventions and offers seats or other accessories, which can be placed & stored in the pack.

Previous inventions are seen in typically bulky, uncomfortable, and inconvenient forms. Although stadium seats are useful and are still carried to games, attempts to market a viable product by combining a seat with waist belt or pack and have met with only limited success. This is due to the inherent bulk of attaching a conventional seat pad to a pack and the inconvenience and extra space required. Few people want a bulky or a rigid seat attached behind them or an item to fuss with. Inflatable seats work to some degree and are less bulky but you still have to pump them up which is time consuming and inconvenient.

The invention is a padded pack with easy access to the pack and tools within with easy access with both top and side openings to the pack. The invention is simple to use and requires little attention to use or adjust the protective garment or padding on ski lifts, stadium seats, boat bottoms, car seats, park benches etc. . . .

The invention is a wrap around waistband used between jacket, shirt, and pant for warmth, and to prevent water from entering a person's clothes. It is recognized that water and snow may enter the invention which adds weight especially if it becomes completely submerged during water sports such as fishing, surfing, and boating. However, versions of the invention allow water to escape through openings, which exist or are provided in the fold area when it is in a closed or folded position. Certain versions of the invention made for water sports provide netting required to allow a significant amount of water to pass through the invention while keeping items within the pack.

The invention is significantly more slender and looks quite like an ordinary or contemporary waist pack on its outward appearance but provides a seat without being typically bulky. Further, with its combination of many features, it is more widely acceptable by consumers and has far more uses than just seating.

The invention's seating, quite unlike typical stadium seating or other prior inventions, may be used or carried effortlessly during participation or the viewing of sport events For instance, a back packer or skier will usually carry a pack and since the seat function actually forms the pack, one could argue that you're not actually carrying a seat at all if you intend to carry a pack anyway! Now seating and padding is available and convenient even during extreme sports. In addition, it can be worn as a waist guard between shirt and pant or jacket and pant to eliminate snow, water or ice from entering or can be worn underneath clothes for warmth or concealing articles. Also, while worn over clothes the invention protects expensive or sporting clothing from premature wear which occurs in buttock, thigh, knee, waist, back and other wear and tear areas on various articles of clothing or to prevent icing where clothing contacts cold air or cold and wet substrate surfaces.

Various types of clothing are available for protecting, padding, and insulating a person's buttocks, waist, legs, and lower torso. These include articles of clothing such as pants and jackets with padding or panels stitched upon them or pads that are stuffed in one's trousers. None combine multi-functional protective padding and garments and other features that form the invention.

Versions of the invention may provide larger accessories such as kneeling cushions, resting cushions, by attachment means for user adaptability and so that they may be removed to eliminate weight or used when needed. These larger accessories are also multi-functional by providing protection while unfolded and to provide more multiple layers of padded and insulated protection for items stored in the pack.

Other outdoor gear is available for outdoor use such as sport padding, space blankets, ground covers, kneeling cushions, seating cushions, hand warmers etc. . . . but none are combined and included in such a compact, slender, comfortable, user friendly, multi-functional and unique manner.

For example, a fly fisherman can store and organize his fly tying and fishing tools, which are readily available, padded and protected. He can then kneel or sit down on rough surfaces, rocks, bushes & stickers, the wet &cold ground, sand, water to fish while keeping his bottom, legs, and pants protected. Also, he can keep his hands warm between tasks. While unfolded or partially unfolded, he can use the protective garment as a surface to work upon. These tasks can be accomplished while wearing the invention or after taken off and placed on the ground and used as a ground cover.

BRIEF SUMMARY OF THE INVENTION

The present invention can be a waist pack, a hand warmer or a warm waistband that is worn comfortably and unfolds to provide a stadium, chairlift, or other seat cover. It also provides a water-resistant, insulate and padding for sitting, kneeling, or laying down on wet and/or cold surfaces in the outdoors.

The invention is utilized by unfolding the pack. The protective garment may be used as a work surface for field medical care, to place tools upon, to tie fishing flies and lures on or any other outdoor uses. In addition, the invention can be wrapped around sports equipment and used as a seat cover, pack, and padding.

Since the invention's seat folds to form the pack there is less material required to provide for these functions, saves space, is efficient, and is a more user-friendly method for providing an insulated water-resistant seat. Also, there is no need for a compartment or pocket solely for storing a seat or other protective garments or materials. In addition, a user doesn't need to fuss with rolling or compacting material into a pocket or connecting a flap or seat to a belt. It does not need to be inflated like other inventions.

The seat is available to be used when needed by simply unfolding a panel in a more user friendly manner and now can be to be worn un-noticed to the game or used during active sports, thereby eliminating the need to carry a separate seat cushion, hand warmer or other protective garment.

Initially, the invention was developed to meet the needs of a snowboarder or a skier. The inventor then realized that the invention had far broader applications and uses. Since the invention is a seat and it also forms a padded pack and sport padding and packs are commonly used during outdoor or extreme sports, seating is now available and totally convenient to use. Waist Packs including protective garments for extreme sport activities such as skateboarding, motocross, were developed as well as packs for carrying sports equipment and tools. Climbers, Hikers, and others involved in outdoors sports and recreation, need an invention that provides protective garments, padding, insulation and seating. The invention virtually eliminates the hassles because all functions are included in one article. The invention does not necessarily need to be taken off or moved to the to the front of the body to gain access to the protective garment or articles stored there.

The invention is especially useful to bicyclers, motorcyclists, climbers, hunters, cross-country skiers, alpine skiers, paddlers, fisherman, surfers, skateboarders, and snowboarders as well as football players, soccer players, runners, and other athletes.

With an optional heat resistant version, campers and firefighters can protect themselves while being close to fires. With all versions: sport spectators, concert fans, and people at the beach would find comfort and protection with this invention.

Construction trades, Gardening, automotive, mechanics, medical, scientific and other workers can also use this invention.

OBJECTS OF THE INVENTION

The primary objective of the present invention is to provide a multi-purpose outdoor combination pack which can be worn comfortably as a warm waist band, and easily unfolds into a protective garment or seat cushion, or folds to provide a hand warmer.

Another object is to provide a padded protective layer/s to protect items in the pack. Other objectives are to provide warmth and padding for the middle and lower torso of a person in partially unfolded positions. Additional variations of the invention could simply be larger versions or accessories that are attached to the invention. Larger versions or accessories that are attached to the invention (which easily fold and are stored neatly in the pack) provide additional cushioning, padding and warm insulation for additional protection to various parts of a person's body. The seat and pack feature padding folds to provide layers of protection for the articles stored within the pack. Other objectives are to provide a guard against snow, ice, and water entering a person's jacket and pants or shirt and pants. Other objectives are to provide buttock, knee, or lower torso padding for comfort and to protect from injuries or to kneel upon during outdoor activities. Other objectives of the invention are to provide a hand warmer (provided by folding the protective garment and/or a hand warming pocket stitched onto the invention's panels) and permanent pockets and/or removable attachable pockets or containers, and straps to wrap and secure protective garments around various parts of a person's body or sports equipment. Other versions provide attachments or straps to secure electronic, audio, tools, canteens, shovels, and other sports equipment to the invention's panels. The invention lends itself well to carrying, securing and padding a snow shovel often used by snowboarders or backcountry skiers. The pack is padded which will protect articles within the pack and will protect the body from bruising or injury during sports, recreation, and work. Also, the invention can insulate beverages in water pouches and prevent fluids from freezing.

The invention further may have a promotional use. Names and logos can be placed on the invention to advertise a business.

Multiple names or signage can be printed on the multiple folds of the invention. For example, a company logo could be placed on an exterior panel while a slogan or phrase placed on an interior panel. When the user unfolds the pack to utilize the seat panel for instance viewers nearby will see the advertisement. These advertising aspects make the invention more useful and unique.

The invention can also be used as a blanket to treat patients injured outdoors. The invention provides leg padding or protectors for various parts of a person, a wrap around clothing providing warmth and padding, padding for the buttock and lower torso. The invention protects clothes from premature wear. The invention can be worn over clothes or under clothes. It can conceal items. It can provide warmth to keep muscles loose. Other uses include a survival blanket, sleeping bag pad, lean-to shelter, vehicle seat cover, and a padded pack to prevent shock or breakage to articles stored within. The invention has many configurations and uses. It should be expressly understood there are other uses realized that are not necessarily described above.

The invention was designed so it can be folded and unfolded easily so articles within the pack can be easily removed from side openings or from the top opening while worn behind of a user. The invention can be worn comfortably on the front and sides of a user allowing freedom of movement during sports and outdoor activities. In a preferred version of the invention, flexible and multi-purpose protective textiles such as neoprene are used. These textiles lend themselves to the invention in providing increased storage capacity within the pack by stretching and securing articles tightly as well as a providing a multi-purpose, water-resistant, insulated, and padded fabric. Other textiles such as nylon, Lycra, rubber, foam and laminates can be utilized with weight savings.

The following could use the invention: snowboarders, skaters, skateboarders, skiers, hunters, fisherman, climbers, hikers, beach goers, travelers, workers, spectators, photographers, mechanics, gardeners, tourists, motor-vehicle riders, equestrian riders, boaters, paddlers, couriers, bicyclists and others.

Waist packs have become popular and have replaced traditional bags because people need their hands free in sport related activities. The inventor noticed snowboarders sitting in the snow and realized they need protection to keep their posterior dry while sitting on chairlifts or sitting or lying down on the snow. I experimented with various water-resistant or padded materials.

As a result of the experimentation, protective garments folded to form packs were developed. By attaching a belt or straps it becomes a multi-purpose and combination waist pack which provides a hand free means to carry articles as well a multitude of other uses where an water-resistant, insulate, and or padded article may be needed. It didn't take long to discover the hand-warming feature inherent to the design of the pack.

Folding rectangular sheets or similar sheets of textiles to form a pack was difficult and not practical to fold and utilize while worn behind a user. The solution was to make two opposing circular cuts away from the perimeter of the invention by removing material in the fold. It is recognized that diagonal and vertical cuts instead of circular cuts for similar purposes are not outside the scope of this invention.

Without circular cuts, v-shaped or similar cuts, the article would be more difficult and inconvenient to fold while utilizing the invention. The circular cuts allow the fabric to facilitate folding easily while worn behind a user. This provides a more user friendly, purposeful, and unique article. Accessories or pads that may be attached to the invention have similar acruate circular cuts to facilitate folding.

Specialized garments for the ski industry such as ski or snowboarder pants, oversized coats and sport padding have been developed. The problem is they are cumbersome, heavy and hot. Ice, therefore, often forms on them during use. As result, the ice melts and the clothing becomes wet later when stored indoors. The waist pack of the instant invention can be folded and shaken to eliminate any accumulated icing to decrease drying time. It is less likely to become wet since it is worn in a compact unit on the waist and used as a supplementary protective garment when needed. Also, the invention prevents ice or snow entering one's pants, shirt or jacket with a tight, snug and contoured fit. Further, because the fabric is an insulating material, body heat does not warm the outer surface to cause snow to melt on it, which is the source of ice on traditional garments.

Clothing exterior remains dryer and warmer when in contact with the invention preventing icing to occur on those surface areas.

The invention is a combination pack and protective comfort article for outdoor activities comprised of a sheet of stretchable, water-resistant, padded and/or insulating materials having at least three panels. The panels include a top panel, a middle panel, and a bottom panel. The panels are structured and adapted to be folded along the top transverse crease regions; a first crease area between the top panel and middle panel and a second crease area between the middle panel and bottom panel, wherein, folded from the top and bottom panels are folded over the middle panel. A pocket is attached to the middle panel with a lateral opening near to and substantially parallel to the crease between the top panel and the middle panel. Attachment means (securing means) fixed to each panel to secure the panels together when said top and bottom panels are in a position folded over the middle panel. The top panel attachment means is optional and will remain closed adequately without attachments as it is stretched and worn about a person's waist. A waistband extending laterally from the middle panel provides means for attaching the combination pack and protective accessory to the waist of a person.

The invention includes a pack and protective garment convertible to a seat cushion and to a hand warmer. The combination pack and protective accessory provides a seat cushion with a large pocket or alternatively, an apron with hand warmer or pocket. Additional garments or devices can be attached to the invention to provide kneeling cushions, to wrap various parts of a person or larger protective coverage or barriers between a user and a cold and wet substrate surface.

The inventions features are utilized while being worn by the user. It has other uses when removed. An optional version provides heat and or chemical resistant textiles for sitting by campfires or fire fighting.

Preferred versions include:

1. A multi-functional waist pack, which unfolds into a seat, cushion and provides a hand warming pocket or padded article carrying pocket. The pack includes attachment means such as buttons or Velcro for larger coverage such a larger seat cushion or larger, expandable, folding, and protective textiles for kneeling, sitting, or lying down upon, or an overhead cover.

2. A waist pack, which includes features referred to above, further, which folds into a seat cushion and leg insulate which includes attachment means such as buttons or snaps for removable accessories or pockets as well as additional padding and insulation for various parts of the body.

Versions include securing straps, buckles, or other attachment means to attach to sports equipment or vehicles or to wrap protective garments around body.

3. A waist pack, which includes features, referred to above and unfolds to become a ground cover, sleeping bag pad or overhead cover.

4. A waist pack, which includes features referred to above and includes a sleeping bag, survival sack or similar item.

5. A waist pack, which includes features referred to above and includes elastic straps or cords capable of carrying and attaching sports related equipment, such as a snow shovel or other equipment.

BRIEF DESCRIPTION OF THE SEVERAL VIEWS OF THE DRAWING

The following illustrations are an example of the preferred embodiment, although variations exist. Therefore, it should be expressly understood that the present invention is not be limited solely to the illustrations:

FIG. 1. including FIGS. 1,2,3,4,5 is a front plan view of the invention adapted to provide a combination waist pack and unfolded to provide a seat cushion. A pocket provides a hand warmer. An accessory FIG. 5 provides lower leg protection and padding, a ground cover to lie down on, a garment to kneel on, a garment to pull overhead or to protect a user's upper and/or lower body.

FIG. 1 is a front plan view of the invention in the partially folded position and unfolded to provide a protective garment and bottom panel 11. that includes attachments.

FIG. 2 is a front plan view of the invention in folded pack position to provide a slender waist pack.

FIG. 3 is a front plan view of the invention in the partially folded position with the pocket opening formed from folding and adapting the pack.

FIG. 4 is a front plan view of the invention with a protective garment 23 extended to cover tops of hands, wrists, and arms when hands are placed in hand warming pocket.

FIG. 5 is a front plan view of the accessory 27. attached to the invention's garment by attachments 26.

DETAILED DESCRIPTION OF INVENTION

The following illustrations are an example of the preferred embodiment, although variations exist.

Therefore, it should be expressly understood that the present invention not be limited solely to the illustrations:

FIGS. 1,2,3,4,5 are front plan views of the invention adapted to provide a combination waist pack and unfolded to provide a seat cushion. A pocket is stitched into the invention, which holds articles and/or provides a hand warmer. Larger versions &/or accessories provide a pack including lower leg protection and padding, a ground cover to lie down on, a garment to kneel on, a garment to pull overhead or to wrap around a user's upper and/or lower body. FIG. 1 is a front plan view of the invention in the partially folded pack position and unfolded to provide the bottom panel 11. which includes attachments 26 for additional protective accessory 27. FIG. 5. The invention is adapted to provide an accessory to provide a seat cushion including lower leg protection and padding, a ground cover to lie down on, a garment to kneel on, a garment to pull overhead or to wrap around a users upper or lower |torso. Attachments on the garment and accessory and many of its numerous attributes are seen in this illustration.

Figure 2:
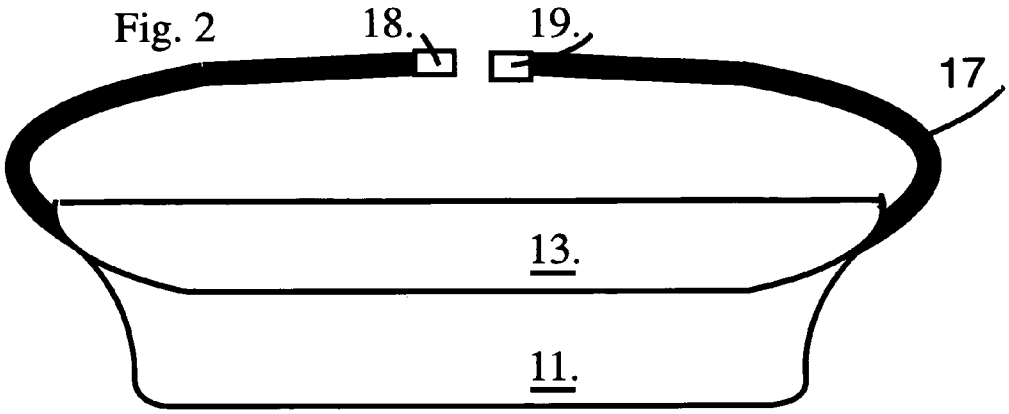

FIG. 2 is a front plan view of the invention in a folded pack position to provide a slender waist pack, which is also a tummy, kidney, back warmer and padding.

Figure 3:
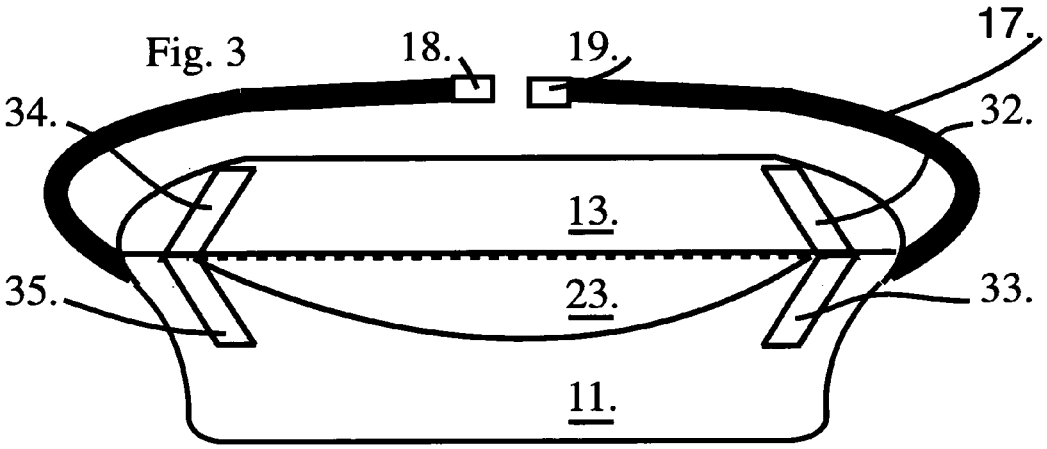

FIG. 3 is a front plan view of the invention in the partially folded position with the pocket opening formed from unfolding the top panel 13 and adapting the pack while the pocket is also closed from extra material 23 provided for forming the pocket by folding the pocket flap 23).

Figure 4:
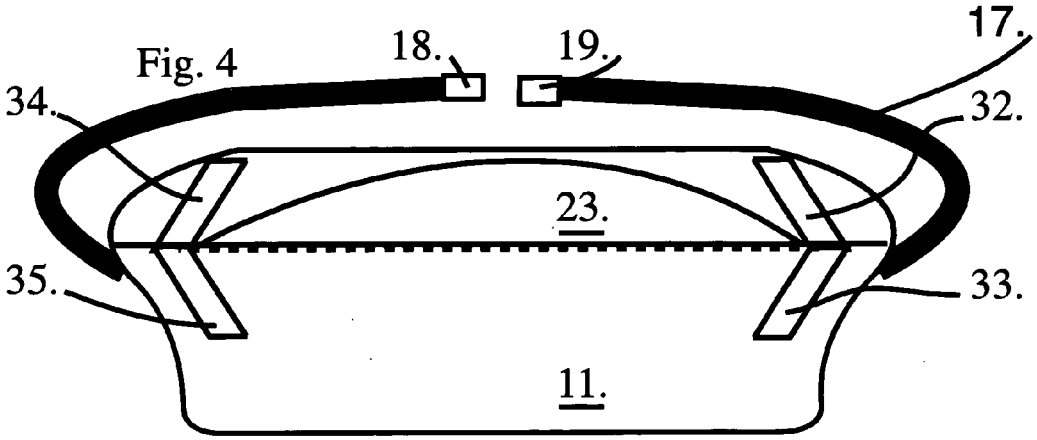

FIG. 4 is a front plan view of the invention with a protective garment 23 extended to cover tops of hands, wrists, and arms when hands are placed in hand warming pocket. Hands or items can be placed in either the pocket formed by adapting the invention or the pocket provided.

FIG. 5 is a front plan view of the invention with multiple panels as a removable accessory 27. FIG. 5 is attached to the invention FIG. 1 by attachments 26 and stored in the pack, which is formed by adapting the invention, such as FIGS. 2,3,4. The multiple panels provide straps for padding placed onto the packs panel 24 or pockets in the pack FIGS. 2,3 and 4 or alternatively items place onto or within the protective accessory.

Figure 6:
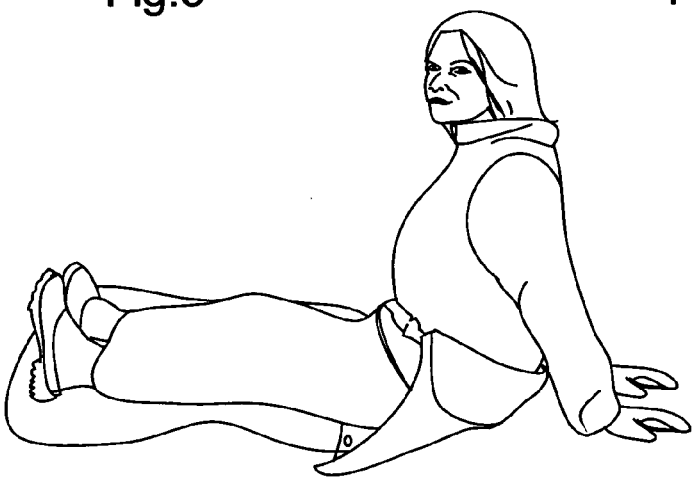
FIG. 6, FIG. 7, FIG. 8, and FIG. 9 are front perspective views of the invention worn by users.
Figure 7:
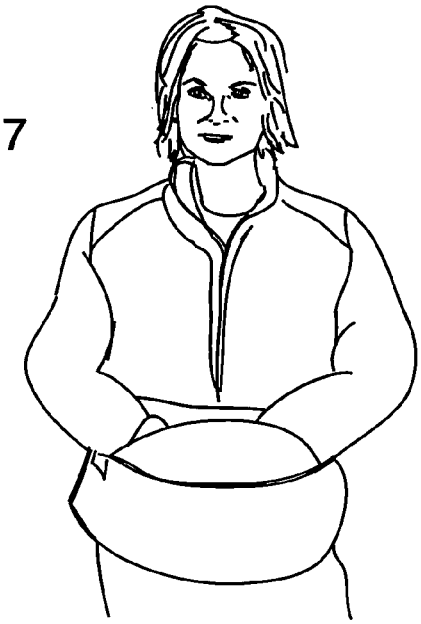
Figure 8:
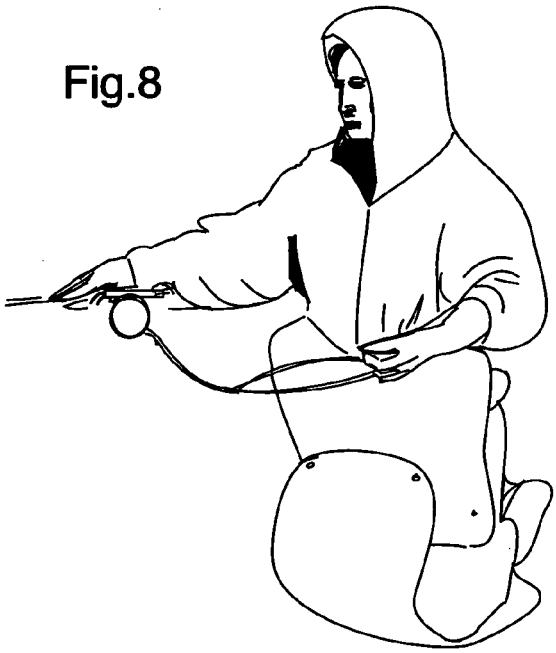
Figure 9:
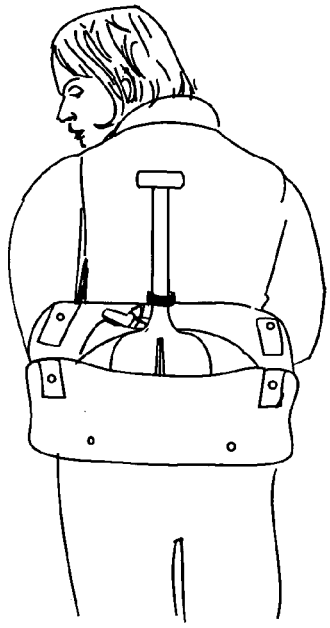

FIG. 6, FIG. 7, FIG. 8, & FIG. 9 are front perspective views of the invention worn by users. FIG. 6 is for seating with a larger protective accessory attached. FIG. 7 is used as a hand warmer. FIG. 8 is shown used for kneeling, a fisherman is example shown. FIG. 9. is shown worn behind a user and the invention is capable of carrying, padding and securing a canteen and snow shovel.

Using the drawings as reference and to FIG. 1 which includes FIGS. 1,2,3,4,5,6,7,8.9. FIG. 1. shows the combination waist pack in a unfolded and adapted position 10 wherein 11 provides a protective seat cushion. The waist pack is made of stretchable, water-resistant, padded and/or insulating sheet material such as neoprene and has at least three panels; a top panel 13, a middle panel 12, and a bottom panel 11 wherein the panels are structured and adapted to be folded along transverse crease regions. A first crease region 15 is located between top panel and middle panel and a second crease region 14 between the middle panel and bottom panel where top panel 13 and bottom panel 11 are foldable over the middle panel 12. The bottom panel 11 provides a protective seat pad for protecting one's posterior and legs when one is in a seated position. The middle panel 12 includes a pocket 16 with a lateral opening near to and substantially parallel to the crease between the top panel and middle panel. Middle panel 12 is provided with a waistband 17 extending laterally from the middle panel provides attachments to secure the combination pack and protective accessory to the waist of a person. The example shown includes straps 17 with opposed connectable male 18 and female 19 closures. The closure is connected to the belt or straps and the male closure 18 allows expansion and contraction for different waist sizes. Attachment means 20 (securing, closure, sealing means) are fixed to each panel to secure the panels together when said top and bottom panels are in a position folded over the middle panel. The top panel attachment means is optional, as it will remained closed adequately without attachment means as it is stretched and worn about a person's waist. The combination pack and protective accessory panels are structured and adapted and folded along at least two transverse crease regions 14 and 15, and the opposite lateral edges of the invention's sheet preferably have arcuate edges between middle and bottom panels. The concave, opposite edges provide a reduced transverse distance along second crease region, 21.

As a result of the these edges, a more useful and versatile article is attained by eliminating wrinkling or resistance while folding and unfolding the waist pack thus providing trouble free folding of the combination waist pack as it encircles a person's waist and while being worn comfortably behind a user. A stretchable fabric provides a pocket 22, which is attached to the middle panel with a lateral opening near to and substantially parallel to the crease between the top panel and middle panel. Additional pocket fabric 23 is provided above the transverse crease 15 between the top panel and middle panel to form a closure flap. Additional attachments means such as loops or cords 24 are provided at various locations for securing articles to the invention such as tools or sports equipment. Additional pockets 25 are provided at various on locations on the invention for storing articles or pads.

The article is shown in a closed position in FIG. 2, which is the typical manner in which it is worn. FIG. 3 and FIG. 4 show the article in a partially folded position. FIG. 2 is a front plan view with panel 13 folded over panel 11, which is folded upwards over panel 12 (not visible). Velcro™ or other fastening means secures panel 13 to panel 11. The waist pack may be worn with folded panels behind, to the side, or front of a wearer. Also, the waist pack may be worn with folded panels 11 and 13 against or away from the wearer's body when in a folded condition. FIGS. 3 and 4 shows |the article in a partially folded and open position where panel 13 is raised (FIG. 3) but flap 23 is shown, keeping the adjustable pocket in a closed position. While in FIG. 4, 23 is raised and the pocket is open. Further, in FIGS. 3 and 4, Velcro strips 32, 33, 34, 35 are shown where strips 32 and 33 make contact and 34 and 35 make contact where panel 13 is folded over 11 to secure the panels to one another. Velcro strip 32 and 34 are on the inside surface of panel 13 while Velcro strips 33 and 35 are on an external surface of panel 11. FIG. 5 is a plan view of a four-panel accessory in an open condition. The accessory provides extended protective surface to protect a person seated, kneeled, & laying down. Alternatively, the accessory provides covers to a person's body parts from cold, dampness, impacts etc. . . . FIG. 5. may be a part of the article or on a separate attachment panel. The bottom panel 30, middle panels, 29, 28, and top panel 27 provides attachment means 26 for securing the protective accessory, FIG. 5 with one or more crease regions in various configurations to provide a comfortable garment and protective accessory to various parts of the body. The opposite lateral edges of the protective accessory FIG. 5 have concave arcuate edges between panels 28 with the concave shape of the edges providing a reduced area along its folding creases 29. The protective FIG. 5. provides straps, buckles, cords, buckles or other attachment means 30 to attach or wrap accessories to a person, sports equipment, or other article. Optionally, attachments 31 for securing, closure, sealing are fixed to each panel on the protective accessory FIG. 5. The panels close together when said top and bottom panels are in a position folded over the middle panel to form another pack capable of storing, providing padding, and securing articles or to adjust the length of the protective garment in it's various partially folded positions while worn on a user.

I claim:

1. In combination, a pack formed from a garment having a means for providing combined upper, middle and lower torso body part coverage is combined with a protective accessory having a means for providing upper, middle and lower torso body part protection for outdoor activities comprising:

a. a sheet of fabric for said garment having a plurality of panels for said means for providing combined upper, middle and lower torso body part coverage with at least three panels which are substantially equal in size: a top panel, a middle panel, and a bottom panel, wherein, said panels are structured and adapted to be folded along transverse crease regions; a first crease region between said top and said middle panel and a second crease region between said middle panel and said bottom panel, wherein, the crease regions are structured and positioned to permit said top panel and said bottom panel to be folded over said middle panel, attachments as a securing means fixed to at least two of said panels to secure said panels together when said top panel and said bottom panel are in a position folded over a middle panel b. a sheet of material for said protective accessory having at least one panel for said means for providing upper, middle and lower torso body part protection, heretofore, three panels which are substantially equal in size: a top panel, a middle panel, and a bottom panel, wherein, said panels are structured and adapted to be folded along transverse crease regions; a first crease region between said top and said middle panel and a second crease region between said middle panel and said bottom panel, wherein, the crease regions are structured and positioned to permit said top panel and said bottom panel to be folded over said middle panel, attachments as a securing means fixed to at least two of said panels to secure said panels together when said top panel and said bottom panel are in a position folded over a middle panel c. a means for attaching said sheet of material at predetermined positions upon said sheet of fabric whereby protecting a person's body parts while providing a fabric barrier between said accessory and a person while providing said accessory in a more compact and efficient manner d. said garment having a interior surface while folded with a means for attaching said protective device at said predetermined and sandwiched position upon said interior surface whereby concealing said protective accessory while compactly stored within said garment e. said means for attaching the garment to a person's waist, equipment, and vehicles.

2. Said garment of claim 1 wherein said top panel is partially folded or lengthened provides said means for providing combined upper, middle and lower torso body part coverage as a waist warmer or padding.

3. Said garment of claim 1 wherein said top panel is partially folded or lengthened provides said means for providing combined upper, middle and lower torso body part coverage as a waist warmer and padding, kidney warmer and padding and back warmer and padding.

4. Said garment of claim 1 wherein said top panel is partially folded or lengthened provides said means for providing combined upper, middle and lower torso body part coverage as a waist warmer and padding, kidney warmer and padding, back warmer and padding and overhead cover.

5. Said protective accessory of claim 1 wherein said top panel is partially folded or lengthened provides said means for providing combined upper, middle, and lower torso body part protection as a waist guard and kidney guard.

6. Said protective accessory of claim 1 wherein said top panel is partially folded or lengthened provides said means for providing combined upper, middle, and lower torso body part protection as a waist guard, kidney guard, and spine protector.

7. Said protective accessory of claim 1 wherein said top panel is partially folded or lengthened provides said means for providing combined upper, middle, and lower torso body part protection as a waist guard, kidney guard, spine protector and back guard.

8. Said garment of claim 1 wherein said middle panel provides said means for providing combined upper, middle, and lower torso body part coverage as a waist warmer and padding, stomach warmer and padding and kidney warmer and padding.

9. Said protective accessory of claim 1 wherein said middle panel provides said means for providing combined upper, middle, and lower torso body part protection as a waist guard, kidney guard or tailbone guard.

10. Said garment of claim 1 wherein said bottom panel is partially folded or lengthened provides said means for providing combined upper, middle, and lower torso body part coverage as a buttock warmer or padding.

11. Said garment of claim 1 wherein said bottom panel is partially folded or lengthened provides said means for providing combined upper, middle, and lower torso body part coverage as a buttock warmer or padding, tailbone padding, and a kneeling cushion.

12. Said garment of claim 1 wherein said bottom panel is partially folded or lengthened provides said means for providing combined upper, middle, and lower torso body part coverage as a seat padding, a kneeling cushion and a ground cover.

13. Said protective accessory of claim 1 wherein said bottom panel is partially folded or lengthened provides said means for providing combined upper, middle, and lower torso body part protection as a tailbone guard and buttock guard.

14. Said protective accessory of claim 1 wherein said bottom panel is partially folded or lengthened provides said means for providing combined upper, middle, and lower torso body part protection as a tailbone guard, buttock guard and leg guards.

15. Said garment of claim 1 wherein said fabric is flexible and water resistant rubber, neoprene, nylon or heat resistant textiles.

16. Said protective accessory of claim 1 wherein said material is polyethylene plastic, polyethylene foam, urethane foam, rubber neoprene or leather.

17. Said garment and said protective accessory of claim 1 wherein a pocket is attached to said middle panel with a lateral opening near to and substantially parallel to the crease between the top panel and the middle panel whereby providing a hand warmer in partially folded or lengthened positions.

18. Said garment and said accessory of claim 1 wherein said securing means fixed to at least said two panels secure said panels secure said panels together are textile-loop attachments and buttons.

19. Said garment of claim 1 wherein said means for attaching said sheet of material for said accessory at said predetermined and sandwiched positions upon said sheet of fabric for said garment are buttons and textile loop attachments.

20. Said garment of claim 19 wherein said means for attaching said sheet of material for said accessory at said predetermined and sandwiched positions upon said sheet of fabric for said garment are flexible straps whereby providing removable said protective accessory while maintaining elasticity with said fabric of said garment while providing said accessory.

21. Said garment of claim 1 wherein having a exterior surface while unfolded with said means for attaching said protective device at said predetermined positions upon a parameters of said garment whereby further lengthening said protective accessory.

22. Said garment and said accessory of claim 1 wherein said panels are structured and adapted to be folded along said transverse crease regions have concave and arcuate edges between panels with the shape of a opposed edge(s) providing a region of reduced transverse dimension along it's folding creases whereby with said garment; lessening weight, decreasing ripping as with angled cuts meeting to a point while eliminating snagging and unnecessary bending of excessive material and whereby with said accessory; allowing said panels to fold along said transverse crease by removing material in said crease region, significant if said accessory is made |from substantially rigid material.

* * * * *